United States Patent [19]

Geraci

[11] Patent Number: 4,929,022

[45] Date of Patent: May 29, 1990

[54] CHAIR HAVING LIFT APPARATUS

[76] Inventor: Alexander Geraci, 5221 N. Lind Ave., Chicago, Ill. 60630

[21] Appl. No.: 314,164

[22] Filed: Feb. 23, 1989

[51] Int. Cl.[5] ..... A47C 1/02

[52] U.S. Cl. ..... 297/313; 297/DIG. 4; 297/DIG. 10; 297/183; 297/339

[58] Field of Search ..... 297/183, 338, 339, DIG. 10, 297/313, DIG. 4; 280/289 WC

[56] References Cited

U.S. PATENT DOCUMENTS

| | | | |
|---|---|---|---|
| 4,456,086 | 6/1984 | Wier et al. | 297/DIG. 4 |
| 4,506,930 | 3/1985 | Lambert | 297/DIG. 10 |
| 4,519,649 | 5/1985 | Tanaka et al. | 297/DIG. 4 |
| 4,598,944 | 7/1986 | Meyer et al. | 297/339 X |
| 4,632,455 | 12/1986 | Schiller et al. | 297/DIG. 4 X |

*Primary Examiner*—Peter A. Aschenbrenner
*Attorney, Agent, or Firm*—Samuel Kurlandsky

[57] ABSTRACT

A chair having lifting means for assisting a physically impaired occupant to arise out of the chair, the chair having a frame, a seat having its forward edge hingedly mounted on the frame, and means for applying lifting force to cause the rear edge of the seat to be lifted upwardly to assist the occupant to arise, comprising foot-operated lever means arranged to impart lifting force to the seat when the occupant applies foot force to a foot step connected to the lever means, manually operated lever means to apply lifting force when the manually operated lever means is pulled back by the hands of the occupant, means for coupling the foot-operated lever means with the manually operated lever means, and, in a preferred embodiment, spring means providing additional force in assisting the seat to be raised, the arrangement being such that when the occupant steps on the foot step and pulls back on the manually operated lever means, the rear portion of the seat is raised and assists the occupant to arise out of the chair. In an additional embodiment the same mechanism is used in a wheel chair having occupant lifting capabilities.

16 Claims, 3 Drawing Sheets

CHAIR HAVING LIFT APPARATUS

BACKGROUND OF THE INVENTION

1. Field of the Invention

The present invention relates to chairs, and more particularly refers to a chair having a lift mechanism to assist a physically impaired person sitting in the chair to lift himself out of the chair, and additionally to provide a means of exercising by repeatedly utilizing the manually operated levers and the foot-operated levers.

2. Description of the Prior Art

Several chairs have been disclosed in the prior art having means for assisting occupants who are physically impaired to lift themselves out the chair. In some of the structures electric motor driven apparatus is utilized to lift the chair occupant. In others hydraulic cylinders are utilized to assist in lifting the occupant. These are all very heavy to move around, require an external power source, and are very expensive to fabricate. Other arrangements have been disclosed which utilize pivotal or tilting seats. However, they have not been entirely satisfactory, and additionally have been prohibitively expensive.

SUMMARY OF THE INVENTION

It is an object of the invention to provide a chair having means to assist a physically impaired occupant to arise out of the chair.

It is a further object of the invention to provide a chair of the type described which is relatively easy to operate by the occupant without help from another individual.

It is still further an object of the invention to provide a chair of the type described which does not require an external power source.

It is another object of the present invention to provide a structure according to the present invention which can be utilized as a wheel chair.

It is an additional object to provide structures of the type described which are relatively simple to construct and which additionally are relatively inexpensive.

It is still further an object to provide an apparatus of the type described which may be used to provide exercise for the occupant who may be too physically impaired to utilize ordinary means of exercise.

The foregoing and other objects, advantages and characterizing features of the invention will become apparent from the following description of certain illustrative embodiments thereof, considered together with the accompanying drawings, wherein like reference numerals signify like elements throughout the various figures.

According to the invention, a chair is provided having lifting means for assisting a physically impaired occupant to get out of the chair, the structure of the invention comprising a frame having similar frame members on both sides of the chair, a seat member having its forward edge hingedly connected to an upper and forward portion of the frame, lever means operatively connected to the seat operated by applying foot force against a foot rest, lever means operatively connected to apply lifting force to the seat operated by manual force, and extension spring means operatively arranged to apply additional lifting force for the seat, the arrangement being such that when the occupant of the chair applies force with his feet against the foot rest and at the same time applies manual force by pulling on the manual lever means rearwardly, the combination of the applied forces together with the force of the extension spring, when it is so used, assists the occupant in getting out of the chair and attaining a standing position. The occupant may also engage in exercise by continually moving the hand-engaging levers and the footrest-engaging levers backward and forward.

DESCRIPTION OF THE PREFERRED EMBODIMENTS

Figure 1:
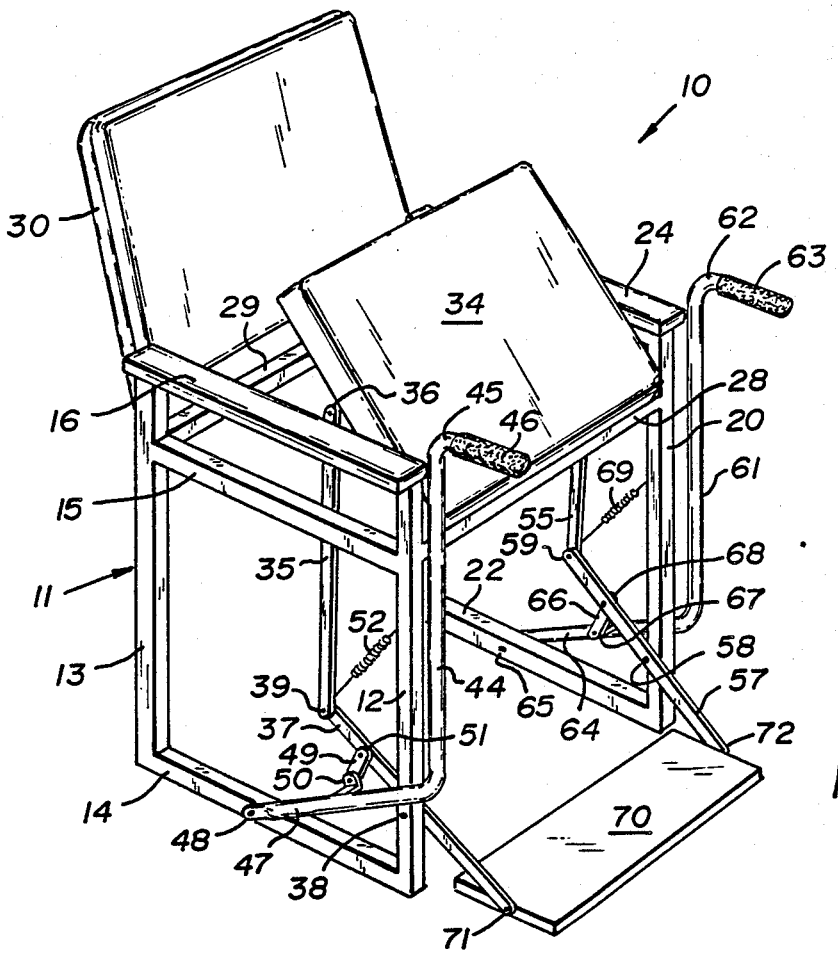
FIG. 1 is a perspective view of a chair having lift means, according to the invention.

Referring to FIG. 1, a chair 10 according to the invention is shown, comprising a frame 11 having identical frame members on the right and left sides. The frame 11 comprises on the right side a front vertical frame member 12, a rear vertical frame member 13, a lower horizontal frame member 14, an upper horizontal frame member 15, and an arm rest 16.

The frame 11 comprises on the left side a front vertical frame member 20, a rear vertical frame member, not shown but similar to the right rear vertical frame member 13, a lower horizontal frame member 22, an upper horizontal frame member, not shown but similar to the right upper horizontal frame member 15, and an arm rest 24.

The right and left portions of the frame are connected together by a front horizontal frame member 28, and a rear horizontal frame member 29. A back support 30 is mounted on the frame 11. A seat 34 is hingedly mounted at its forward end to the front horizontal frame member 28.

The apparatus for assisting in raising an occupant out of the chair comprises an assembly of lever means which are identical on both the right and left sides of the chair. On the right side the apparatus assembly comprises a vertical seat lift member 35 pivotally connected to one side of the seat 34 by a pivot assembly 36. A foot-operated lever member 37 is pivotally connected at a mid-portion to the front vertical frame member 12 by a pivot pin 38 and is pivotally connected at one end to the vertical seat lift member 35.

The assembly on the right side further comprises a manual-operated lever 44 having an offset handle bar 45 having a handle grip 46 mounted thereon. The lower portion 47 of the lever 44 is offset and pivotally connected at its end to the lower horizontal frame member 14 by a pivot pin 48. A coupling member 49 is pivotally connected at one end to offset portion 47 by a pivot pin 50, and at the other end to the lever member 37 by a pivot pin 51. An extension spring 52 is connected at one end at the coupling of the extension member 35 with foot operated lever member 37, and at the other end to the vertical frame member 12. The spring 52 biases the seat to the upwardly extended normal position, and additionally adds force to assist in lifting the occupant when he desires to get out of the chair.

The apparatus on the left side of the lift chair of the invention for assisting in lifting the occupant out of the chair comprises a left vertical seat lift member 55 pivotally connected to the left side of the seat 34 by a pivot assembly, not shown, but identical to the pivot assembly 36. A foot-operated lever member 57 is pivotally connected at a mid-portion to the front vertical frame member 20 by a pivot pin 58 and is pivotally connected at on end to the left vertical seat lift member 55 by a pivot pin 59.

The assembly on the left side further comprises a manually-operated lever 61 having an offset handle bar 62 having a handle grip 63 mounted thereon. The lower portion of the lever 61 has an offset 64 which is pivotally connected at its end to the lower horizontal frame member 22 by a pivot pin 65. A coupling member 66 is pivotally connected at one end to the offset portion 64 by a pivot pin 67, and at the other end to the foot-operated lever member 57. An extension spring 69 is connected at one end at the coupling of the extension member 55 with the foot-operated lever member 57, and at the other end to the vertical frame member 20. The spring 20 cooperates with the spring 52 to bias the seat to the upwardly extended normal position, and to add force to assist in helping the occupant to get out of the chair.

A footstep 70 is mounted between the ends of the foot-operated lever members 37 and 57 and is affixed thereto by pivots 71 and 72.

Figure 2:
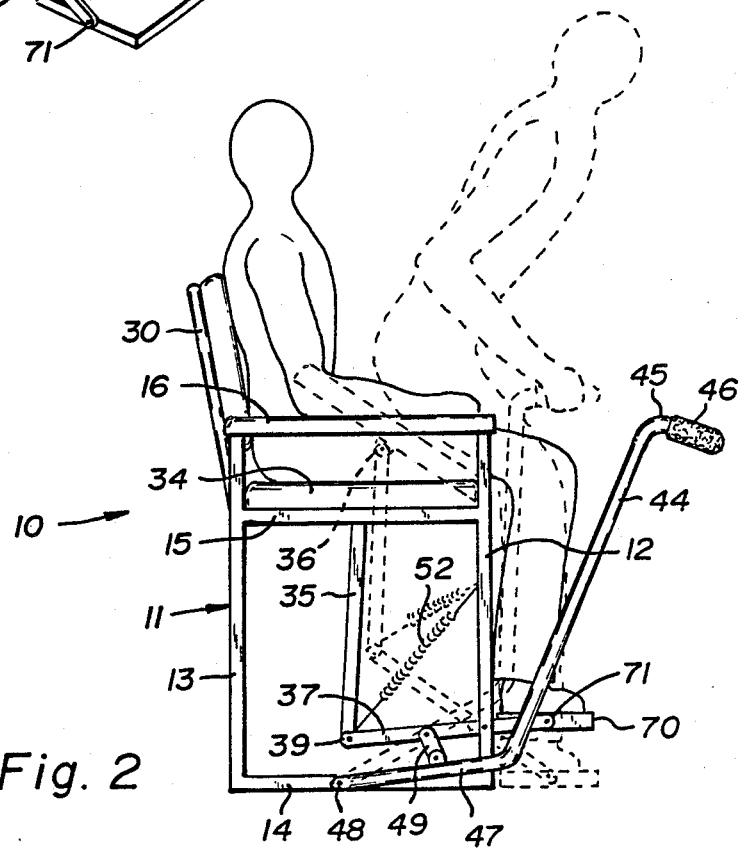
FIG. 2 is a side elevational view of the chair of FIG. 1 showing an occupant sitting in the chair, as shown by solid lines, and showing the occupant and the apparatus in broken lines as the occupant is raising himself out of the chair.
Figure 4:
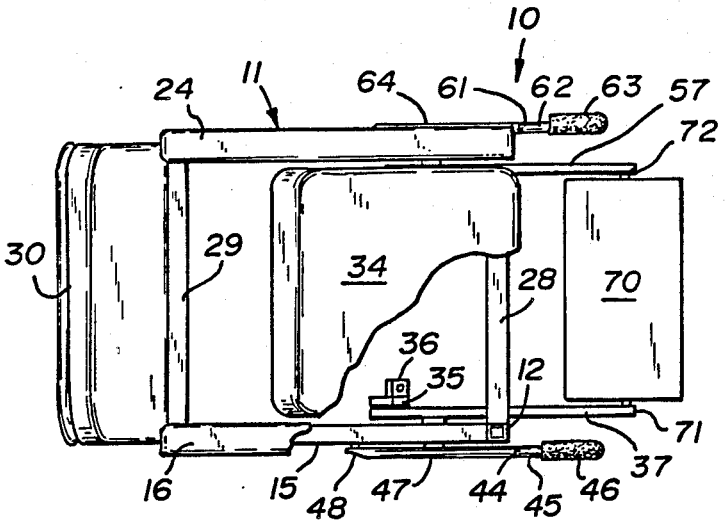
FIG. 4 is a top view of the chair, with a portion of the seat broken away, with the apparatus in the same position shown in FIG. 3.
Figure 3:
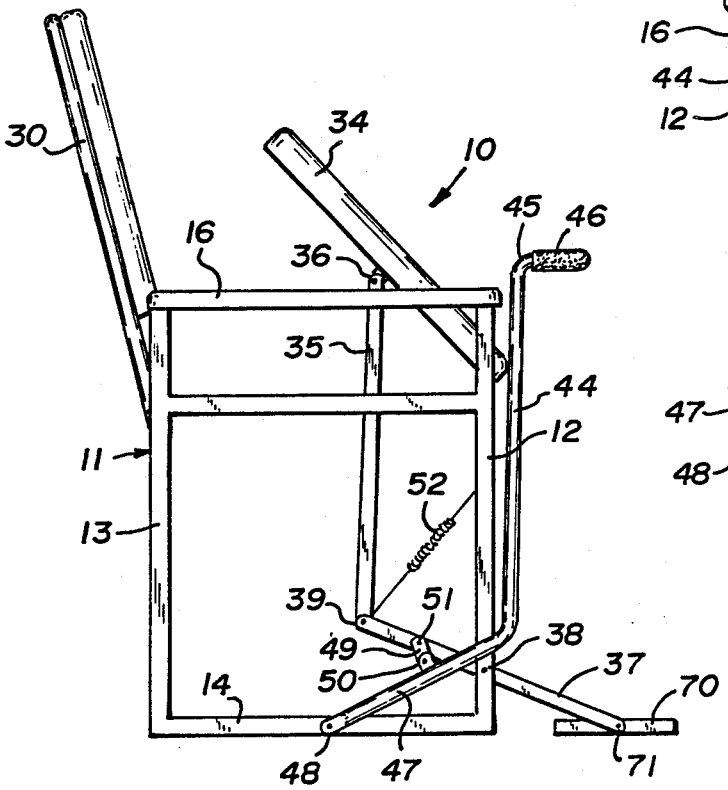
FIG. 3 is a side elevational view showing the chair with the seat in fully extended position spring-biased by the extension spring after the occupant has left the chair.
Figure 5:
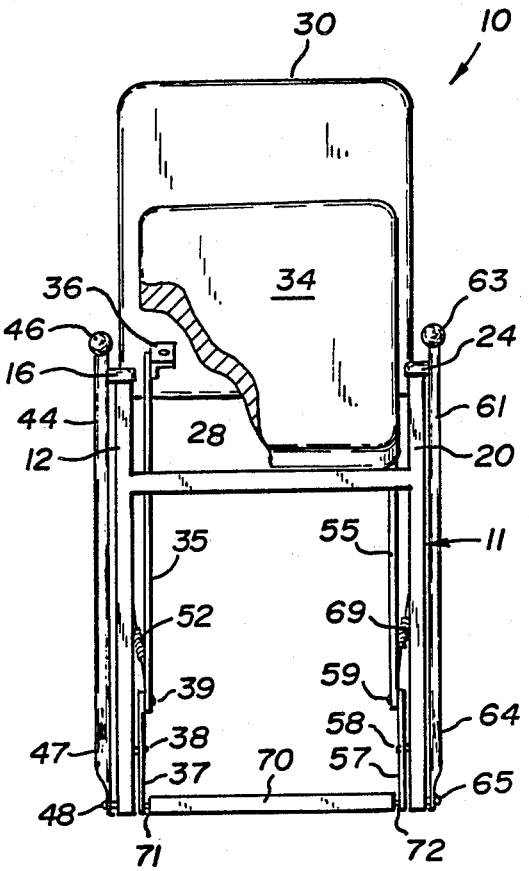
FIG. 5 is a front elevational view of the chair as shown in FIGS. 3 and 4.

Referring to FIGS. 1, 3, 4 and 5, the chair is shown in normal stationary position, with the springs 52 and 69 maintaining the seat 34 in the upwardly extended position, the manually operated levers 44 and 61 in the rearwardmost position, and the foot rest 70 in the downwardmost position. When an occupant wishes to seat himself in the chair, he steps on the footrest 70 and sits back on the seat 34. The weight of the occupant depresses the seat against the spring and causes it to swing downward to the horizontal rest position. At the same time the manually operated levers 44 and 61 are caused to swing forwardly, and the foot-operated levers 37 and 58 together with the foot step 70 to rise to an upward position. Referring to FIG. 2, this set of conditions is shown by the solid lines. When the occupant wishes to remove himself from the chair, he shifts his weight forward, exerting force with his feet against the foot rest 70, causing force to be applied to the seat lifting members 35 and 55. At the same time he grasps the hand grips 46 and 63 and pulls rearwardly, causing upward lifting force to be transmitted through the coupling members 49 and 66 and adding these forces to the force exerted against the seat lifting members 35 and 55. Additionally, the springs 52 and 69 apply a force in the same direction. The sum of the forces urges the seat upwardly. The seat applies this combined force to the occupant to assist him in getting out of the chair. This is shown by the broken lines in FIG. 2.

Figure 6:
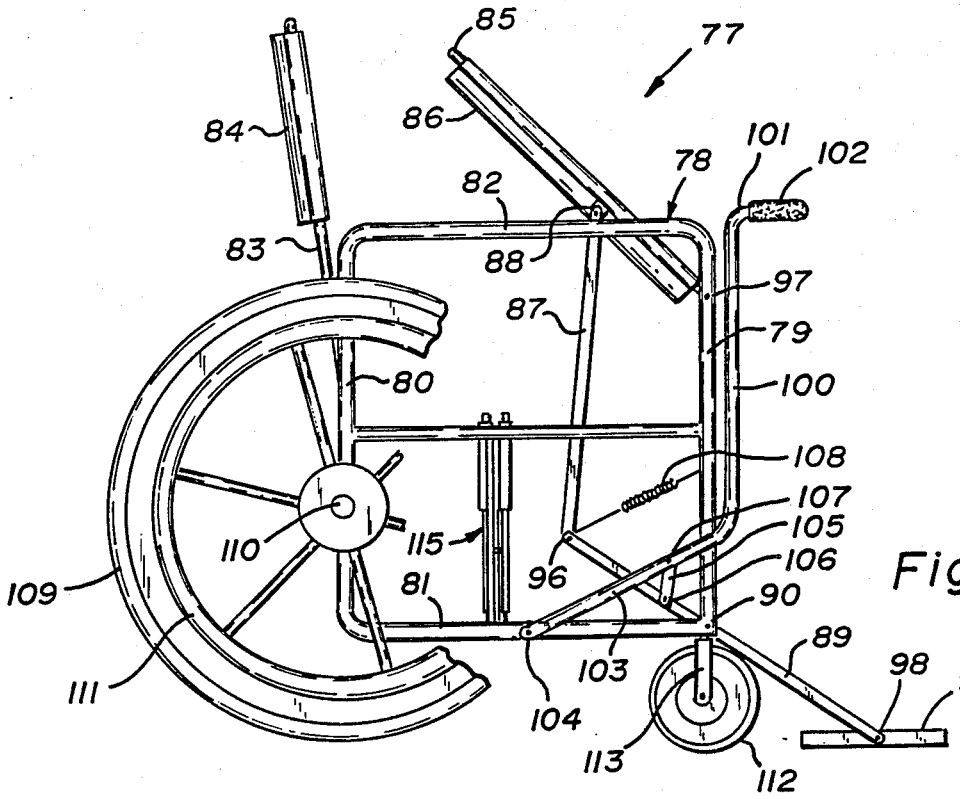
FIG. 6 is a side elevational view of another embodiment of the invention, with the chair and lifting apparatus being in the form of a wheelchair.
Figure 7:
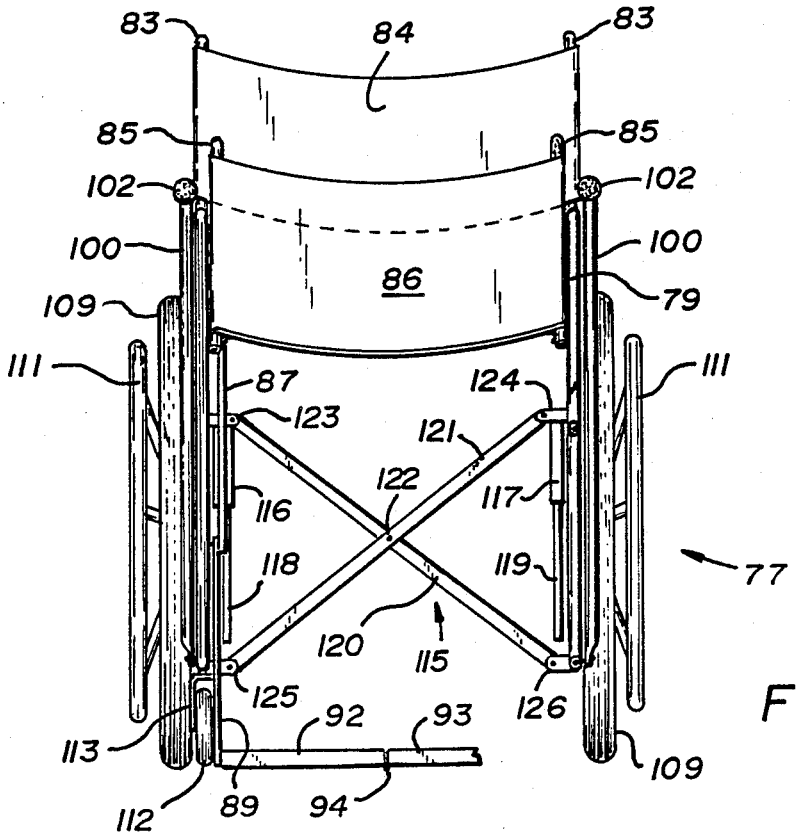
FIG. 7 is a front elevational view of the embodiment shown in FIG. 6.

Referring to FIGS. 6 and 7, an alternative embodiment of the invention is shown. Basically the lifting leverage structure and operation of this embodiment is similar to that of FIGS. 1–5. However, the embodiment of FIGS. 6–8 is in the form of a wheel chair having seat lifting capabilities, and therefore the folding structure of this embodiment is especially adapted for use with the lifting structure. The chair 77 comprises a frame 78 comprising right and left front vertical frame members 79, right and left rear vertical frame members 80, right and left lower horizontal frame members 81, and right and left upper horizontal frame members 82. A back support is provided by right and left back support members 83 having a canvass back 84 affixed thereto. A pair of right and left seat support members 85 are pivotally connected to the right and left front vertical frame members 79 by means of pivot or hinge assemblies 97. A canvass seat 86 is affixed at its edges to the seat support members 85.

The apparatus for assisting in lifting the seat assembly includes a pair of right and left vertical seat lift members 87 pivotally connected to the seat support members 85 by pivot assemblies 88. Lifting force is provided by three assemblies which cooperate together to exert force against the vertical seat lift members 87. The first comprises a pair of right and left foot-operated lever members pivotally mounted on the frame 78 by pivot assemblies 90. One end of each foot-operated lever member 89 is pivotally connected to the lower end of a vertical seat lift member 87 by a pivot assembly 96. A foot rest 91 comprised of foot rest members 92 and 93 connected together by hinges 94. The foot rest member 91 is pivotally connected at its ends to the ends of the foot-operated lever members 89 by pivot assemblies 98.

The second assembly for providing lifting force comprises a pair of right and left manually operated lever members 100 each having a handle bar 101 and a hand grip 102 at one end. Each lever member 100 has an angular offset portion 103 which is pivotally hinged at its end to a lower horizontal frame member 81 by a pivot assembly 104. A pair of right and left coupling members 105 are each connected at one end to the foot operated lever members 89 by pivot assemblies 106, and at the other end to the offset portions 103 by pivot assemblies 107.

The third assembly for exerting upward force against the seat comprises a pair of right and left extension springs 108 which are affixed at one end to the joints of the foot-operated lever members 89 with the vertical seat lift members 87. The springs 108 are so biased as to exert a loading force urging the rear portions of the seat support members 85 to their uppermost position when there is no occupant in the chair.

As shown in FIGS. 6 and 7, a pair of right and left large wheels 109 are pivotally mounted to the frame by pivot assemblies 110, and have hand rails 111 affixed thereto. A pair of right and left small wheels 112 are mounted on rotatable trunions to permit the wheel chair to be steered in any direction.

The apparatus for extending the two sides of the frame into operating condition and for collapsing the two sides of the frame for storage is conventional, and comprises a folding assembly 115, formed by a pair of right and left fixed tubes 116 and 117, respectively, affixed to the chair frame, and a pair of sliding members 118 and 119 slidably disposed within the tubes 116 and 117, respectively. The folding assembly additionally includes a pair of folding cross members 120 and 121 pivotally connected near their midsections by a pivot assembly 122. The upper end of the folding cross member 120 is hingedly connected to the upper end of the sliding member 118 by a hinge assembly 123, and the upper end of the folding cross member 121 is hingedly connected to the upper end of the sliding member 119 by a hinge assembly 124. The lower end of the folding cross member 121 is hingedly connected to a portion of the frame 78 by means of a hinge assembly 125, and the lower end of the folding cross member 120 is hingedly connected to a lower portion of the frame 78 by means of a hinge assembly 126.

The operation of the wheel chair embodiment of the present invention as shown in FIGS. 6 and 7 is basically the same as that of the chair shown in FIGS. 1–5. In the non-use condition the spring 108 urges the seat support members 85 and the seat 86 to the upwardmost position and maintains that position, as shown in FIG. 7. When the occupant seats himself in the chair, the seat 86 and seat support members 85 are pushed downward, the foot support 91 is raised, and the manually operated lever members extend forward. When the occupant wishes to remove himself from the wheel chair, he steps on the foot rest 91, and at the same time pulls rearwardly on the manually operated levers by grabbing the hand grips 102. Both actions, together with the tension of the springs 108, push upwardly on the seat, thereby assisting the occupant in getting out of the wheel chair.

The wheel chair is folded or collapsed for storage or transportation by pressing the right side and left side of the frame together. When so doing, the top ends of the cross bar members 118 and 119 rise and pull the sliding members 120 and 121 upwardly, causing them to slide upwardly in the fixed tubing 116 and 117, respectively until the cross bar members 120 and 121 come together, resulting in the formation of a flat frame which is easy to store or transport.

The folding structure of the wheel chair of the present invention differs in important respects from that of conventional folding wheel chairs. As seen in FIG. 7, the primary difference is in the folding mechanism wherein the top ends of the folding tubes 120 and 121 attach to different members of the chair than do those of a conventional wheel chair. In a conventional folding wheel chair the upper ends of the folding tubes are attached directly to the side tubes of the canvas seat. When the chair folds, the seat tubes which are not firmly attached to the frame, merely come together and fold the canvass seat.

In the lift seat wheel chair of the present invention the upper ends of the folding tubes cannot be attached to the seat because the seat tubes 85, shown in FIGS. 6 and 7, are hinged to the seat frame. Consequently, in order not to interfere with the action of the raising and lowering of the seat, the upper ends of the folding tubes must be attached to the frame of the chair with sliding tubes, as shown n FIGS. 6 and 7.

The chairs of the present invention have a number of advantages over prior art structures. They do not require an external power source for their operation. The structures provide a strong force generated by the occupant himself to assist himself in getting out of the chair. The chairs are relatively inexpensive to fabricate from readily available materials. Additionally, the structure is easily adaptable as a wheel chair, providing all the benefits of the lift mechanism without adversely affecting the operation of the chair as a wheel chair.

An important element in the design of the lift chair of the present invention is that it may be designed to be about 5 inches higher than the height of conventional chairs. As a result, the foot rest may also be designed to be 5 inches above the ground in the seated position. This additional height makes sitting down occupant's buttocks rest against the seat without the need to bend or stoop. Sitting down is very smooth, safe and easy.

Another important feature of the invention is that the chair may be used as an exercise device. When the elderly or the physically impaired are required to sit for extended periods of time, they can stand and sit down repeatedly in an exercise mode. Moreover, the spring tension can be made adjustable to increase or diminish the exertion which must be expended in getting up or sitting down.

Although the invention has been described in connection with only specific embodiments thereof, it is evident that many alternatives, modifications, and variations will be apparent to those skilled in the art in the light o f the foregoing description and drawings. Accordingly, it is intended to embrace all such alternatives, modifications and variations within the spirit and scope of the appended claims.

Invention is claimed as follows:

1. A chair having lifting means for assisting a physically impaired occupant to arise out of the chair, comprising:

a frame, a seat hingedly mounted at its forward edge to said frame, foot-operated lever means pivotally mounted on said frame having a foot rest to one end, manually operated lever means pivotally mounted on said frame having hand engaging means at one end, coupling means pivotally connected to both said foot-operated means and said manually operated means arranged to combine the forces generated by each of said lever means, and seat lift lever means pivotally connected at one end to one of said foot-operated lever means or said manually operated lever means, and at the other end to said seat, the arrangement being such that when the occupant applies force to both said foot-operated lever means and said manually operated lever means, the combined force is transmitted to said seat and causes said seat to push said occupant out of the chair.

2. A chair according to claim 1, wherein a spring is additionally connected at one end to said frame and at the other end to an end of one of said lever means, thereby generating a force combining with the forces produced by said lever means to assist in lifting said seat.

3. A chair according to claim 1, wherein said foot-operated lever means comprises a pair of levers pivotally mounted one on each side of said frame, and said seat lift lever means comprises a pair of levers connected one on each side of said seat, and each lever pivotally connected at one end to one of said foot-operated lever means.

4. A chair according to claim 3, additionally having a pair of springs, each attached at one end to said frame and at the other end near or at the connection between said seat lift lever means and said foot-operated lever means, thereby providing additional force combining with the forces generated by said lever means to assist in lifting said seat.

5. A wheel chair having lifting means for assisting a physically impaired occupant to arise out of the chair, comprising:

a frame, a pair of large wheels pivotally mounted on said frame, a pair of small wheels pivotally mounted on said frame and arranged to be steered, a seat hingedly mounted at its forward edge to said frame, foot-operated lever means pivotally mounted on said frame having a foot rest at one end, manually operated lever means pivotally mounted on said frame having hand engaging means at one end, coupling means pivotally connected to both said foot-operated means and said manually operated means arranged to combine the forces generated by each of said lever means, seat lift lever means pivotally connected at one end to one of said foot-operated lever means or said manually operated lever means, and at the other end to said seat, and means permitting the two sides of said frame to be folded together for storage or transportation, the arrangement being such that when the occupant applies force to both said foot-operated lever means and said manually operated lever means, the combined force is transmitted to said seat and causes said seat to push said occupant out of the chair.

6. A wheel chair according to claim 5, wherein a spring is additionally connected at one end to said frame and at the other end to an end of one of said lever means, thereby generating a force combining with the forces produced by said lever means to assist in lifting said seat.

7. A wheel chair according to claim 5, wherein said foot-operated lever means comprises a pair of levers pivotally mounted one on each side of said frame, said manually operated lever means comprises a pair of levers pivotally mounted on each side of said frame, and said seat lift lever means comprises a pair of levers pivotally affixed one on each side of said seat, each pivotally connected at one end to one of said foot-operated lever means.

8. A wheel chair according to claim 6, additionally having a pair of springs, each attached at one end to said frame and at the other end at the connection between said seat lift lever means and said foot-operated lever means, thereby providing force to assist in lifting said seat.

9. A wheel chair according to claim 8, wherein said foot rest comprises a plurality of articulated members.

10. A wheel chair according to claim 5, wherein said seat comprises a pair of spaced apart seat members one pivotally attached to each side of said frame, and a flexible web affixed to and suspended between said seat members.

11. A method for exercising by an occupant seated in a chair, said chair having lifting means for assisting said occupant to arise out of the chair, said chair comprising:

a frame, a seat hingedly mounted at its forward edge to said frame foot-operated lever means pivotally mounted on said frame having a foot rest to one end, manually operated lever means pivotally mounted on said frame having hand engaging means at one end, coupling means pivotally connected to both said foot-operated means and said manually operated means arranged to combine the forces generated by each of said lever means, and seat lift lever means pivotally connected at one end to one of said foot-operated lever means or said manually operated lever means, and at the other end to said seat, the arrangement being such that when the occupant applies force to both said foot-operated lever means and said manually operated lever means, the combined force is transmitted to said seat and causes said seat to push said occupant out of the chair, said method comprising operating by said occupant said foot-operating lever means and said manually operated lever means to lift himself partially out of said chair, and then releasing force on said foot-operated lever means and said manually operated lever means to allow himself to settle back in said chair, the process being repeated as long as the occupant desires the exercise to continue.

12. A method for exercising by an individual seated in a wheel chair, said wheel chair having lifting means for assisting a physically impaired occupant to arise out of the chair, comprising:

a frame, a pair of large wheels pivotally mounted on said frame, a pair of small wheel pivotally mounted on said frame and arranged to be steered, a seat hingedly mounted at its forward edge to said frame, foot-operated lever means pivotally mounted on said frame having a foot rest at one end, manually operated lever means pivotally mounted on said frame having hand engaging means at one end, coupling means pivotally connected to both said foot-operated means and said manually operated means arranged to combine the forces generated by each of said lever means, seat lift lever means pivotally connected at one end to one of said foot-operated lever means or said manually operated lever means, and at the other end to said seat, and means permitting the two sides of said frame to be folded together for storage or transportation, the arrangement being such that when the occupant applies force to both said foot-operated lever means and said manually operated lever means, the combined force is transmitted to said seat and causes said seat to push said occupant out of the chair, said method comprising operating by said individual said foot-operated lever means and said manually operated lever means to lift himself partially out of said wheel chair, and then releasing force on said foot operated lever means and said manually operated lever means to allow himself to settle back in said wheel chair, the process being repeated as long as the occupant desires the exercise to continue.

13. A chair having lifting means for assisting a physically impaired occupant to arise out of the chair, comprising:

a frame, a seat hingedly mounted at its forward edge to said frame, foot-operated lever means pivotally mounted on said frame having a foot rest at one end, and seat lift lever means pivotally connected at one end to one of said foot-operated lever means and at the other end to said seat, the arrangement being such that when the occupant applies force to said foot-operated lever means, the force applied thereto is transmitted to said seat and assists said seat to push said occupant out of said chair.

14. A chair according to claim 13, wherein a spring is additionally connected at one end to said frame and at the other end to one of said lever means, thereby generating a force combining with the force produced by said foot-operated lever means to assist in lifting said occupant from the chair.

15. A wheel chair having lifting means for assisting a physically impaired occupant to arise out of the chair, comprising:

a frame, a pair of large wheels pivotally mounted on said frame, a pair of small wheel pivotally mounted on said frame and arranged to be steered, a seat hingedly mounted at its forward edge to said frame, foot-operated lever means pivotally mounted on said frame having a foot rest at one end, seat lift lever means pivotally connected at one end to said foot-operated lever means and the other end to said seat, and means permitting the two sides of said frame to be folded together for storage or transportation, the arrangement being such that when said occupant applies force to said foot-operated lever means, the force applied thereto is transmitted to said seat and assists said seat in pushing said occupant out of said wheel chair.

16. A wheel chair according to claim 15, wherein a spring is additionally connected at one end to said frame and at the other end to one of said lever means, thereby generating a force combining with the force produced by said foot-operated lever means to assist in lifting said occupant from the chair.

* * * * *